US005183519A

United States Patent [19]

Wechselberger et al.

[11] Patent Number: 5,183,519

[45] Date of Patent: Feb. 2, 1993

[54] METHOD FOR QUENCHING RAILWAY RAIL HEADS

[75] Inventors: Emmerich E. Wechselberger, Glen Ellyn; Ralph S. Frost, Olympic Fields, both of Ill.

[73] Assignee: Chemetron-Railway Products, Inc., Wheeling, Ill.

[21] Appl. No.: 711,632

[22] Filed: Jun. 6, 1991

Related U.S. Application Data

[60] Continuation of Ser. No. 447,234, Dec. 7, 1989, abandoned, which is a division of Ser. No. 27,766, Mar. 19, 1987, Pat. No. 4,938,460.

[51] Int. Cl.[5] ..... C21D 1/20; C21D 1/62

[52] U.S. Cl. ..... 148/582; 148/581; 266/44

[58] Field of Search ..... 148/134, 146, 155, 152, 148/156, 157, 581, 582; 266/115, 134, 258, 44

[56] References Cited

U.S. PATENT DOCUMENTS 4,611,789 9/1986 Ackert et al. ..... 266/81

FOREIGN PATENT DOCUMENTS 186373 12/1984 European Pat. Off. .
657883 4/1979 U.S.S.R. .
978312 12/1964 United Kingdom .

*Primary Examiner*—R. Dean
*Assistant Examiner*—Margery S. Phipps
*Attorney, Agent, or Firm*—Welsh & Katz, Ltd.

[57] ABSTRACT

A method of air quenching a railway rail with an apparatus develops a pearlite microstructure in the head of the longitudinally travelling rail as it travels under the apparatus. A primary air chamber at a controlled pressure provides air to the top and side surfaces of the rail heads. A secondary air chamber at a separately controlled pressure provides air to the shoulders of the rail heads. More than one quench unit may be used in series, in which case the pressures in the primary air chambers may progressively increase to increase the cooling rate.

11 Claims, 2 Drawing Sheets

METHOD FOR QUENCHING RAILWAY RAIL HEADS

This is a continuation of application Ser. No. 07/447,234 filed Dec. 7, 1989, now abandoned, which is a division of application Ser. No. 07/27,766, filed Mar. 19, 1987, now U.S. Pat. No. 4,938,460.

BACKGROUND OF THE INVENTION

This invention relates to a method and apparatus for hardening the heads of railway rails to enhance their wear resistance. As the technical literature summarized in U.S. Pat. No. 4,611,789 indicates, the best combination of wear hardness and certain other mechanical properties in rail heads are achieved by a fine pearlite microstructure. As this patent also indicates, such a microstructure may be developed by heating the heads of an axially moving rail to austenizing temperatures and then quenching the heads with air or other cooling means but not so rapidly as to develop hard martensite or bainite in the microstructure.

Until recently, rails having a nominal minimum head hardness of 248 Brinell was the standard rail in the industry. The chemistry of these rails was such that rails could be quenched with little risk of developing significant amounts of martensite. As loads and speeds have increased however, the industry has specified more wear resistant rails. Thus, rails having a nominal head hardness of 300 Brinell are now specified as standard. The chemistry of 300 BHN rails is such that the quenching operation must be very carefully controlled to avoid overquenching the head to form martensite. In addition, the hardness distribution pattern developed in the rail head must meet industry standards. Thus, the surface hardness of the rail head must be between 346 and 393 BHN, with 388 being desired; the 321 BHN hardness line must be at least 9/16" from the shoulder of the head and ½ from top center; and the hardness must decrease uniformly from the surface to the interior.

SUMMARY OF THE INVENTION

The air quenching unit of the present invention enables very close control of the quenching step. Standard 300 BHN rail strings may be hardened which contain little, if any, martensite or bainite and meet the requirements of the industry. The unit has produced such rail at line speeds of up to about 24 inches/minute. The unit has a perforated plate with a concave surface for confronting the top and side surfaces of the rail head as the rail is axially driven under the unit. A primary air chamber in air-flow communication with the portions of the perforated plate confronting the top and side surfaces of the rail head and a means for supplying air to the primary chamber at a controlled pressure provides a controlled amount of air to those surfaces of the rail head. A secondary air chamber in air-flow communication with the portion of the perforated plate confronting the rail head shoulders and a means for supplying air to the secondary chamber at a controlled pressure provides a controlled amount of air to the shoulders of the head independently of the air provided to the other surfaces. This multichambered structure enables the shoulders of the rail heads to be cooled somewhat independently of the top and side surfaces of the heads. This is desirable because there is a substantial risk of martensite or bainite formation (in certain alloys) at the shoulders where the relatively large (local surface area)/ (local mass) ratio in the shoulder zone tends to result in faster cooling. Preferably, two or more air quenching units of the present invention are spaced apart and the air pressure in the secondary chamber is such that the secondary air flow rate is not more than about 75% of the air flow rate from the primary chamber. This configuration enables a large amount of quench air to escape between the quench units rather than along side the units, which further facilitates controlled cooling of the shoulders.

Other details, objects and advantages of the invention will become apparent as the following description of a present preferred embodiment thereto proceeds.

In the accompanying drawings, a present preferred embodiment of the invention is shown in which:

DETAILED DESCRIPTION

Figure 1:
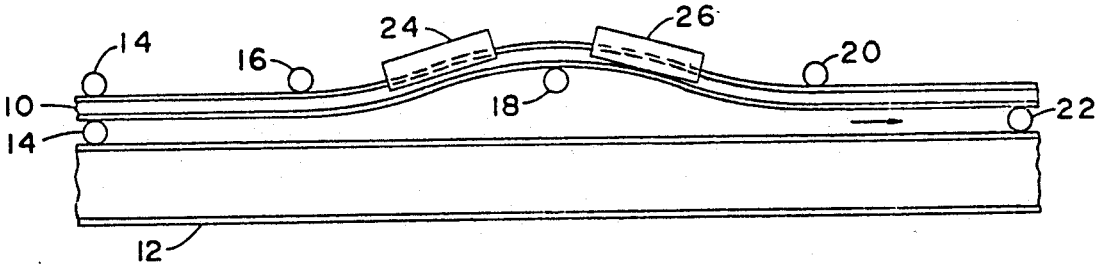
FIG. 1 PRIOR ART
FIG. 1 schematically illustrates a rail head hardending plant in which the air quenching unit of the present invention may be utilized.

FIG. 1 illustrates a well known type of rail hardening plant (shown in, e.g., U.S. Pat. Nos. 4,611,789 and 3,276,924 and in Canadian Patent No. 888,671) wherein a rail string 10 is driven over a stationary base frame 12 by drive rolls 14. The rail 10 is constrained against crowning by rolls 16, 18, 20 and 22 when the rail head is first heated to austenizing temperatures of about 1950° F. by an induction heater 24 and then quenched by a quench unit 26 to develop a fine pearlite microstructure in the head.

Figure 3:
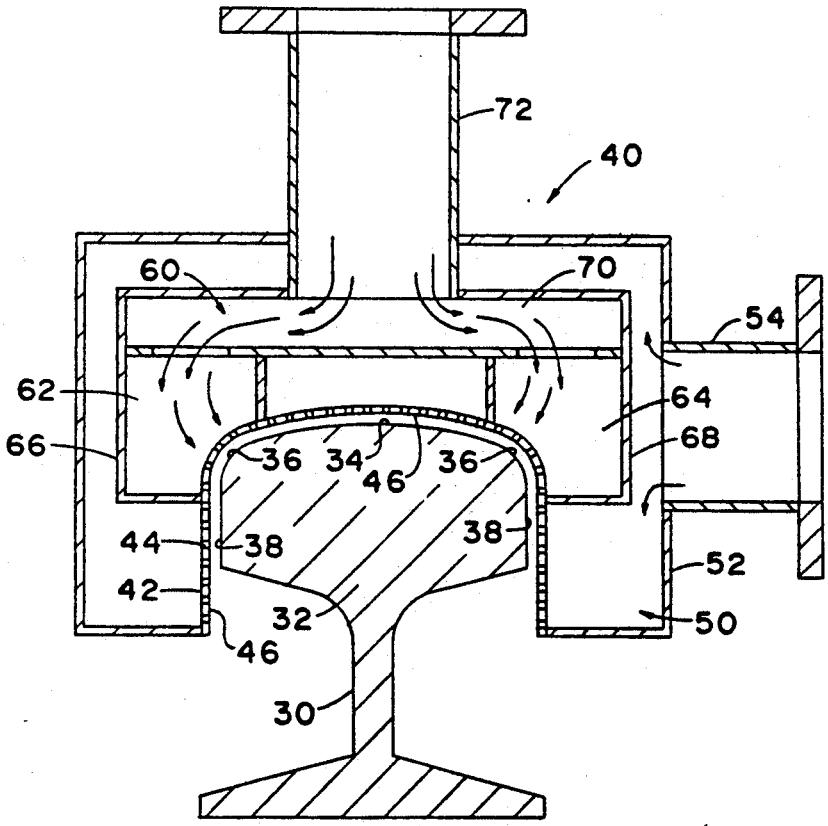
FIG. 3 is a cross sectional view of the air quenching unit of FIG. 2 taken along section line III—III.
Figure 2:
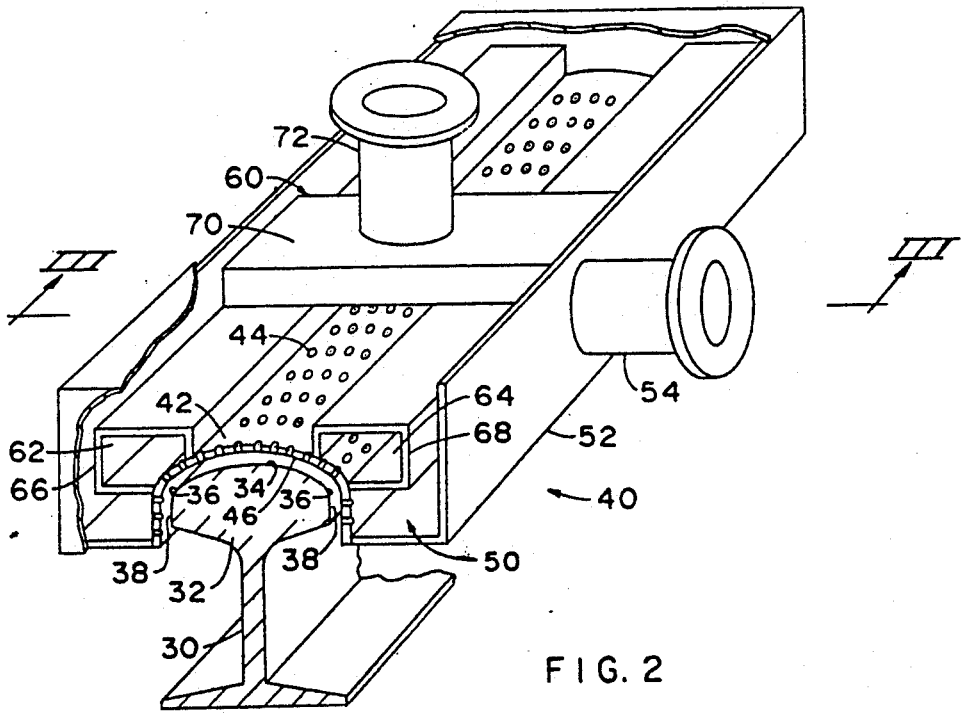
FIG. 2 is a perspective partially fragmentary view of the air quenching unit of the present invention above a rail shown in cross section.

A preferred embodiment of the air quench unit of the present invention is most clearly seen in FIGS. 2 and 3. The quench unit 40 is operative to effect air quenching of a railroad rail, and is shown positioned over a rail 30 having a head portion 32. The surfaces of the rail head 32 which must be hardened are its top surface comprising the running surface 34 on which the wheels of the trains actually ride shoulder surface 36 alongside the running surface, and side surfaces 38. The quench unit 40 comprises a curved plate 42 with perforations 44 having a concave surface 46 for confronting the top and side surfaces of the head. The perforations may be orifices as shown or alternatively elongated holes. Preferably, the orifices are no larger than about ½ inch in diameter. The orifices may have the same or different diameters and may be disposed on the same or different centers depending upon rail chemistry, line speed and available air pressure. It is also preferred that the distance between the plate 42 and the rail head 32 be about 3/16 inch and no more than ¼ inch (where the heat transfer coefficient is generally acceptable) as the heat transfer improves by a factor of 10 when the distance is reduced from about ½ inch or more to 3/16 inch.

A primary air quenching fluid chamber 50 is generally defined by the perforated plate 42 and a housing 52 welded thereto. A flanged nozzle 54 is welded to the side of the housing. An air line 56 having an in-line pressure regulating valve 58 (shown in FIG. 4) or other pressure control means may be connected between an air supply header 80 and the nozzle 54 for supplying air to the primary chamber 50.

A secondary air quenching fluid chamber 60 is disposed within the primary air chamber 50 for providing air to the shoulders of the rail heads. The secondary air chamber generally comprises two passageways 62 and 64 defined by the portions of the perforated plate 42 confronting the shoulders of the rail head and headers 66 and 68 welded thereto and interconnected by a cross header 70. A flanged nozzle 72 extends from the cross header 70 through the top of the housing 52 for connection to an air line 74 having an in-line pressure regulating valve 76 or other pressure control means for providing air from an air supply header 80 at a controlled pressure. If there is a risk of martensite formation, the pressure in the secondary air chamber is maintained below the pressure in the primary air chamber. In the preferred embodiment, the primary air nozzle 54 faces a header 68 to baffle and distribute the primary air in the primary air chamber so that air from the air lines does not directly impinge on the rail head. This arrangement also enables the use of relatively long quench units having a plate length parallel to the rail heads which is longer than the length of the plate perpendicular to the rail head.

Figure 4:
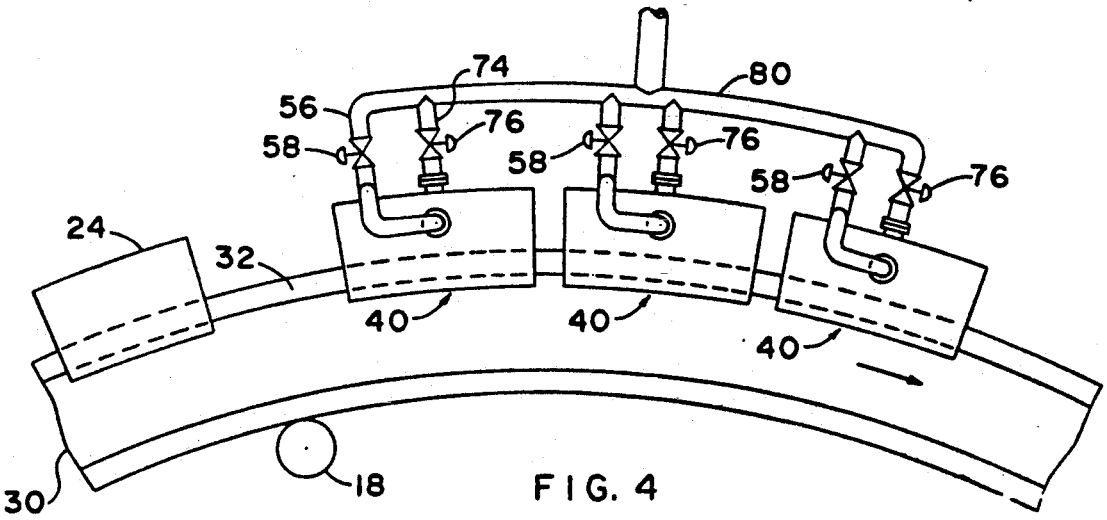
FIG. 4 schematically illustrates the use of three of the quenching units shown in FIGS. 2 and 3.

FIG. 4 illustrates a preferred embodiment of the invention wherein three spaced apart air quench units 40 are utilized to quench the head of a rail being driven below at high speeds. The use of a plurality of quenching units enables the various zones to be transversely subdivided and each subzone individually controlled. Control may be enhanced by spacing the quench units one from the other so that large portions of the quench air from one unit may escape at the ends of the quench unit rather than along its sides. Alternatively, units may not be spaced in cases where such an air flow pattern is not needed. In a test of the embodiment of FIG. 4, three quenching units were operated at primary air pressures of about 5, 6 and 50 psig in the leading, second and third quench units with the secondary air flow rate at about 75% of the primary air flow rate and very good head hardened 300 BHN rails were produced at line speeds of about 24 inches/minute. The use of a plurality of units in series over the rail heads and progressively increasing the cooling rates of the units allows the rail head to be heated in layers so that the rail surface is not quenched too quickly (thus forming bainite or martensite) and/or the rail interior is not quenched too slowly (forming coarse pearlite).

While a present preferred embodiment of the invention has been shown and described, it is to be distinctly understood that the invention is not limited thereto but may be otherwise variously embodied within the scope of the following claims.

What is claimed is:

1. A method of air quenching the heated head of an axially moving railway rail from austenizing temperatures to develop a pearlite microstructure in the head, and wherein the rail head has a top running surface, laterally opposite side surfaces, and a shoulder surface between each side surface and the top running surface, said method comprising the steps of:

passing the rail head longitudinally through a plurality of quenching units which are longitudinally aligned and each of which includes first housing means defining primary quenching fluid chambers having fluid discharge means operative to confront only the top and side surfaces of the rail head when passed through the quenching units, and second housing means defining a pair of secondary quenching fluid chambers having fluid discharge means operative to confront only the shoulder surfaces of the rail head when passed longitudinally through the quenching units;

introducing quenching air into the primary and secondary chambers of the first of the aligned quench units so as to cool only the top and side surfaces of the rail head at a first cooling rate and simultaneously cool only the shoulder surfaces of the rail head at a lower cooling rate; and introducing quenching air into the primary and secondary chambers of each successive quench unit so as to cool only the top and side surfaces of he rail head at a progressively faster cooling rate in each successive quenching unit, and simultaneously cool only the shoulder surfaces of the rail head in each successive quench unit at a lower rate than the cooling rate for the top and side surfaces.

2. The method as defined in claim 1 wherein the fluid discharge means of each of said quenching fluid chambers includes an elongated perforated plate having a perforated concave surface curved about the longitudinal axis of the plate for confronting the respective top, shoulder and side surfaces of a rail head when passed longitudinally through the quenching unit in spaced relation to said concave surfaces, said primary quenching fluid chambers communicating with perforations confronting only the top and side surfaces of the rail head, said second housing means defining a pair of discrete secondary quenching fluid chambers communicating with perforations confronting only the shoulder surfaces of the rail head, said steps of introducing quenching air into said primary and secondary chambers comprising introducing said quenching air at differential pressures.

3. The method of claim 2 wherein each of said quenching units includes first quenching fluid supply means communicating with said primary chambers, and second quenching fluid supply means communicating with said secondary chamber, said top of introducing quenching air into said primary and secondary chambers comprising controlling the quenching air pressure supplied to said first and second supply means.

4. The method of claim 2 including the step of causing quenching air to be indirectly passed to the performations confronting the top and side surfaces of a rail head when passed through the quenching units.

5. The method of claim 4 wherein said step of causing quenching air to be indirectly passed to said perforations includes causing said quenching air to impinge a baffle as it is introduced into each primary chamber.

6. The method of claim 2 wherein said step of introducing quenching air to said secondary chambers includes controlling the quenching air to effect discharge from the perforations confronting the railhead shoulder surfaces at a rate less than 75% of the rate of quenching air discharged from the perforations confronting the top and side surfaces of the rail head.

7. The method of claim 2 including the step of maintaining the rail head at a distance no greater than approximately one-fourth inch from said perforated concave surface when passed longitudinally through said quenching units.

8. The method of claim 1 wherein said quenching units are supported in longitudinally spaced relation.

9. The method of claim 2 wherein said primary and secondary chambers have opposite ends, and including the step of selectively introducing quenching air to said primary and secondary chambers through said open ends in sufficient quantity to cause quenching air to escape from the opposite ends of the primary and secondary chambers of at least one of the quench units.

10. The method of claim 2 wherein said step of passing the rail head longitudinally through a plurality of quenching units comprises passing the rail head through three aligned quenching units, and including the step of introducing quenching air into the primary chambers of said three quenching units at approximately 5, 6 and 50 psi, respectively, in the leading, second and third quench units, and introducing quenching air into the secondary chambers at a pressure equal to approximately 75% of the pressure of quenching air introduced into the corresponding primary chambers.

11. A method of air quenching the heated head of an axially moving railway rail from austenizing temperatures to develop a pearlite microstructure in the head, and wherein the rail head has a top running surface between each side surface and the top running surface, said method comprising the steps of:

passing the rail head longitudinally through a plurality of longitudinally aligned quenching units each of which includes first housing means defining a primary quenching air chamber having a perforated plate defining a concave discharge surface for confronting only the top and side surfaces of the rail head when passed through the corresponding quench unit, and second housing means defining a pair of secondary quenching air chambers discrete from the primary quenching air chambers and each having a perforated plate defining a concave discharge surface for contronting only the shoulder surfaces of the rail head when passed longitudinally through the corresponding quenching unit;

introducing quenching air into the primary and secondary quenching air chambers of the first quench unit so as to cool only the top and side surfaces of the rail head at a first cooling rate and simultaneously cool only the shoulder surfaces of the rail head at a lower cooling rate; and introducing quenching air into the primary and secondary quenching air chambers of each successive quench unit so as to cool only the top and side surfaces of the rail head at a progressively faster cooling rate in each successive quenching unit, and simultaneously cool only the shoulder surfaces of the rail head in each successive quench unit at a lower rate than the cooling rate for the corresponding top and side surfaces.

* * * * *

UNITED STATES PATENT AND TRADEMARK OFFICE

CERTIFICATE OF CORRECTION

PATENT NO. : 5,183,519

DATED : February 2, 1993

INVENTOR(S) : Emmerich E. Wechselberger and Ralph S. Frost

It is certified that error appears in the above-identified patent and that said Letters Patent is hereby corrected as shown below:

Column 1, line 39, change "1/2" to --1/2"-- so as to indicate 1/2 inch;

Column 2, line 47, insert a comma (,) after "ride", and change "surface" to --surfaces--;

Column 2, line 53, change "1/2" to --1/8--;

Column 4, line 15, change "he" to --the--;

Column 4, line 42, change "chamber" to --chambers--; and change "top" to --step--;

Column 4, line 49, change "mations" to --ations--;

Column 5, line 22, after "surface" insert --, laterally opposite side surfaces, and a shoulder surface--;

Column 6, line 8, change "contronting" to --confronting--.

Signed and Sealed this

Twenty-eighth Day of December, 1993

Bruce Lehman

*Attest:*

BRUCE LEHMAN

*Attesting Officer*

*Commissioner of Patents and Trademarks*